United States Patent [19]

Fukuichi

[11] Patent Number: 4,823,417

[45] Date of Patent: Apr. 25, 1989

[54] CORE STRUCTURE AND METHOD OF ITS MANUFACTURE

[75] Inventor: Miwa Fukuichi, Ibaraki, Japan

[73] Assignee: Kabushiki Kaisha Sanko Vinyl Kogyosho, Japan

[21] Appl. No.: 108,826

[22] PCT Filed: Jan. 23, 1987

[86] PCT No.: PCT/JP87/00043

§ 371 Date: Sep. 22, 1987

§ 102(e) Date: Sep. 22, 1987

[87] PCT Pub. No.: WO87/04605

PCT Pub. Date: Aug. 13, 1987

[30] Foreign Application Priority Data

Jan. 30, 1986 [JP] Japan ..... 61-19003

[51] Int. Cl.[4] ..... A47C 27/08

[52] U.S. Cl. ..... 5/455; 5/458; 156/73.1

[58] Field of Search ..... 5/455, 458, 456, 457, 5/472, 477, 449; 156/292, 73.1

[56] References Cited

U.S. PATENT DOCUMENTS

| | | | |
|---|---|---|---|
| 1,970,502 | 8/1934 | Hamza | 5/458 |
| 2,269,342 | 1/1942 | Johnson | 5/458 |
| 3,056,980 | 10/1962 | Holladay | 5/455 |
| 3,813,716 | 6/1974 | Francis | 5/455 |
| 4,190,917 | 3/1980 | Calleanle | 5/457 |

FOREIGN PATENT DOCUMENTS

| | | | |
|---|---|---|---|
| 1031131 | 6/1953 | France | 5/458 |
| 2404413 | 6/1979 | France | 5/458 |
| 248321 | 12/1981 | France | 5/458 |
| 36-30244 | 11/1961 | Japan . | |
| 38-19540 | 9/1963 | Japan . | |
| 3783 | of 1876 | United Kingdom | 5/458 |
| 253238 | 6/1926 | United Kingdom | 5/457 |
| 340506 | 12/1930 | United Kingdom | 5/457 |
| 444280 | 3/1936 | United Kingdom | 5/457 |
| 621435 | 4/1949 | United Kingdom | 5/458 |
| 774719 | 5/1957 | United Kingdom | 5/348 |

*Primary Examiner*—Alexander Grosz
*Assistant Examiner*—Eric K. Nicholson
*Attorney, Agent, or Firm*—Haverstock, Garrett & Roberts

[57] ABSTRACT

A technical object of this invention is to hold down an inflation of an air cushioned portion of an air filled product required to have a high pneumatic pressure of the air chamber with extremely high load F. For the purpose, in a core structure according to this invention in the middle portions of an upper side leather cloth sheet a pair of core members (4) of a double layer structure (1', 2') identical with the leather cloth sheets (1, 2) is provided, and each core member (4) is fused to each of the upper side and lower side leather cloth sheets at both end portion (5), and middle portions (6) of a pair of core members (4) are sewn with a yarn (7) to be coupled. The core structure according to this invention is particularly suitable for holding down the inflation of bouyance adjusting apparatus for scuba diving and the like.

12 Claims, 2 Drawing Sheets

*"Prior Art"*

*"Prior Art"*

*"Prior Art"*

"Prior Art"

"Prior Art"

"Prior Art"

"Prior Art"

"Prior Art"

CORE STRUCTURE AND METHOD OF ITS MANUFACTURE

TECHICAL FIELD

This invention relates to a core structure for holding down an inflation of mattress, pillow case, rubber boat, life preserver and the like filled with air in its inside which is made of soft plastics or rubber.

BACKGROUND TECHNIQUE

In the core structure of air mattress and the like, an inflation is held down generally by an I-beam system (FIG. 3), X-beam system (FIG. 4) and deformed X-beam system (FIG. 5).

In case of producing a boat, mattress, life preserver and the like by filling air in its ,inside with leather cloth sheets produced by pasting the cloth sheet made of Nylon, cloth and the like and the sheet made of vinyl, urethane, rubber and the like together, in order to secure an air cushioned portion in a proper thickness by holding down its inflation, the upper and lower leather cloth sheets 3 were directly fused (FIGS. 4 and 5), or core members 4 were used which were produced by pasting both end portions of the core members to the upper and lower leather cloth sheets 3 by means of an adhesive (FIG. 3) whereby a core structure was produced. However, in the mattress and the like of the core structure by the conventional systems, when it was used for many years during which an anticipated load F was applied, the fused portion or the pasted together portion 10 was cut giving a cause of a leakage of air filled therein, and particularly, in case of using the core of the I-beam system, the pasted together portion (bonded surface) of the leather cloth sheet and the core member was peeled apart to lose the operation of holding down the inflation in some cases. Let us to explain this phenomenon by referring to FIG. 3, in which in case of the mattress of the I-beam structure, when the load F was applied to the upper portion of the mattress, force F' worked towards the outside around the periphery of an air chamber 8. Also, in case the load F was of magnitude more than the anticipated value, the force F' worked on the periphery of the air chamber 8 greatly. As a result, the bonded surface 10 of the core member 4 was peeled apart from the leather cloth sheet or the cut started from the pasted together portion. Also, in case of the mattress of the X-beam structure, similar to the I-beam system, when the load F was applied in the direction of the upper part, there was an apprehension that the force F' worked towards the outside around the periphery of the air chamber so that the fused surface 10 was broken to cause a leakage of air from the air chamber 8. The deformed X-beam structure had the similar drawback.

However, in the case of the air mattress, air pillow case and the like, the load F was not too big and also, the pneumatic pressure F' of the air chamber 8 was not required to be a high pressure so that the holding down of the inflation of an air cushioned portion could be materialized by the core structure of the conventional system, but the product required to have a high pneumatic pressure of the air chamber with extremely high load F was not suitable, for example, to be used as the core member in a buoyance adjusting apparatus for scuba diving, life preserver and the like.

This invention has been made in view of the foregoing points, and its object is to provide a core structure for air filled product capable of withstanding the large load and internal pressure.

DISCLOSURE OF THE INVENTION

The core according to this invention has a structure, as shown in a cross section of FIG. 1, in which in the middle portions of the upper side and lower side leather cloth sheets 3 formed by pasting the sheets 2 made of the urethane, vinyl and the like and the insides of the cloth sheets 1 made of Nylon, cloth and the like together, a pair of core members 4 of a double layer structure identical with the leather cloth sheets 3 is disposed, and its both end portion 5 are fused to the upper side leather cloth sheet 3 and the lower side leather cloth sheet 3, and the center portions 6 of the core members 4 are sewn with the yarn 7 to couple a pair of core members 4.

Two pieces of core members 4 are sewn and coupled with yarn at the location of the middle portions 6 so that even when the larger pneumatic pressure F' is applied in the periphery of an air chamber 8, they do not separate from the coupled portions. Also, since the leather cloth sheet 3 and the end portion 5 of the core member 4 are fused in face-to-face made, when the larger pneumatic pressure F' is applied into the air chamber, the frictional contact is generated on the fused surfaces of the leather cloth sheet 3 and the core member 4 by the tensile forces A and B in the opposite directions. For this reason, even if the considerable pneumatic pressure is applied to the leather cloth sheet 3 and the core member 4, the do not separate from the fused portions.

Since the core structure according to this invention is constituted in such a manner that the force of the bonded portion of the core member with the leather cloth sheet is held down by the surface, the strength of the bonding force is increased by several ten times compared with the core structure of the conventional products. In case of the high frequency fusing of the upper side and lower side leather cloth sheets of the air filled product, the fusing coupling of a pair of core members can be carried out simultaneously in one process. When a length of the yarn of the coupled portions of a pair of core members is adjusted, or a length of the core members, a length of the fused and coupled portions of the core members and a length of the yarn of the coupled portions of the core members are respectively properly adjusted, whereby an inflation of the air filled product can be optionally changed. Since the strength of the bonding force is increased by several ten times compared with the conventional products instead of the urethane sheet layer used heretofore in the buoyance adjusting apparatus, it can be replaced with a low cost vinyl sheet layer. Furthermore, a remarkable feature is that there is no apprehension that air does not leak outside of the air chamber in case the yarn sewn coupled portion is broken by some chance so that it is particularly suitable for life preserver and the like.

MOST PREFERRED EMBODIMENTS OF THE INVENTION

The core structure and the method of its manufacture according to this invention will be described in the following on the basis of the embodiments illustrated in FIGS. 1 and 2.

Figure 1:
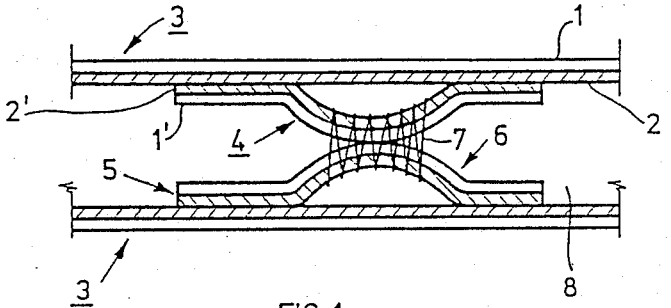
FIG. 1 and FIG. 2 are cross sections of a core member according to this invention.
Figure 2:
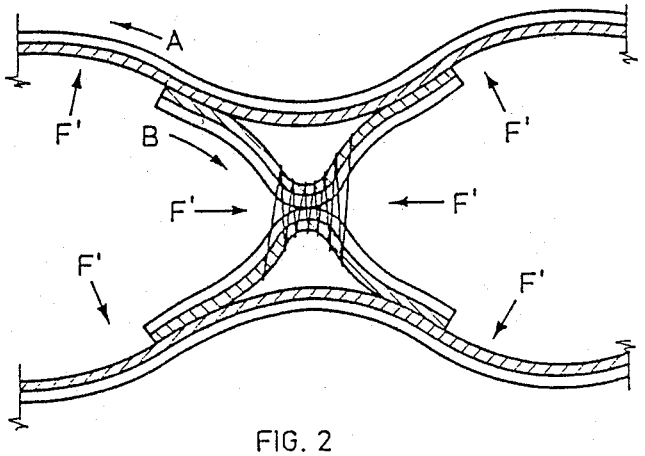
Figure 3A:
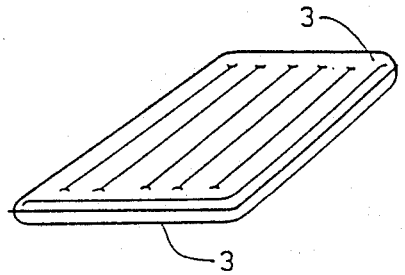
FIGS. 3 through 5 show the core structure of a conventional system, FIG. 3*a* being its perspective view, FIG. 3*b* being its lateral cross section, FIG. 3*c* being its partially enlarged view of FIG. 3*b*, FIG. 4*a* being its perspective view, FIG. 4*b* being its lateral cross section, FIG. 4*c* being its partially enlarged view of FIG. 4*b*, FIG. 5*a* being its perspective view, and FIG. 5*b* being its lateral cross section.
Figure 3B:
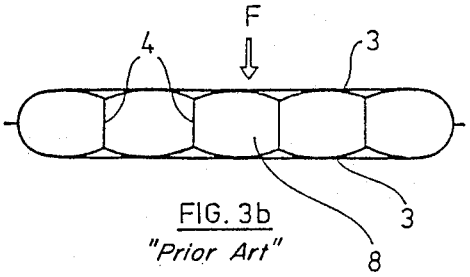
Figure 3C:
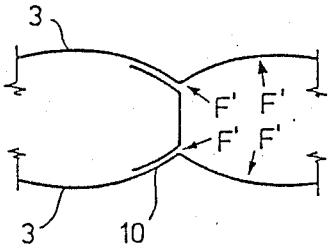
Figure 4A:
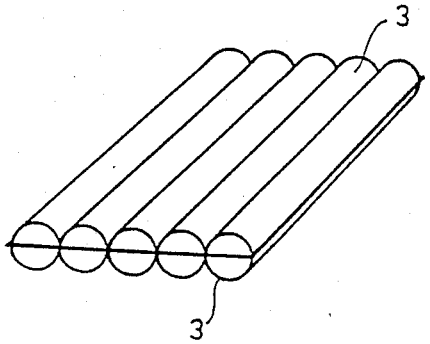
Figure 4B:
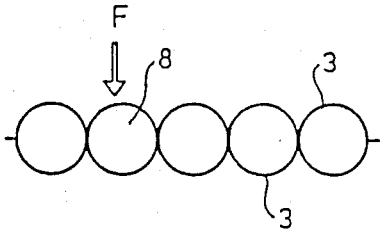
Figure 4C:
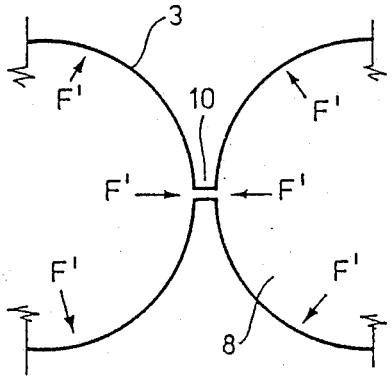
Figure 5A:
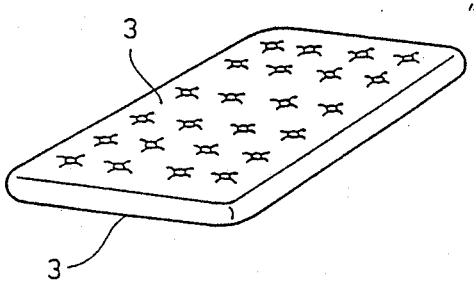
Figure 5B:
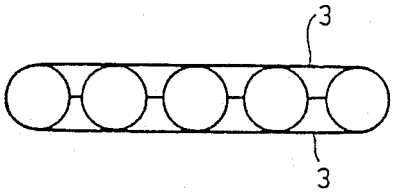

FIG. 1 is a cross section of a core structure according to this invention used in a buoyance adjusting apparatus for use in scuba diving, and shows a condition before air is filled, and FIG. 2 is a cross section similar to FIG. 1 and shows a condition where air is filled. In the scuba diving, a buoyance adjusting apparatus for easy work several ten meters below the sea level is an important apparatus. This buoyance adjusting apparatus is generally constituted in such a manner that the inside 8 of the leather cloth sheet 3 of a couple layer structure consisting of the inside being Nylon cloth sheet layer 1 and the outside being a thin sheet layer 2 made of urethane. This buoyance adjusting apparatus is provided with a core structure functioning to hold down an inflation of an air chamber 8 to facilitate an easy movement in the water. The conventional core structure was made by the deformed X-beam system as shown in FIG. 5, and an explanation is provided by referring to the part of this invention shown in FIG. 1, in which the upper side leather cloth sheet 3 and lower side leather cloth sheet 3 were fused directly by high frequency by means of respective urethane sheet layers 2. The buoyance adjusting apparatus fed air into the air chamber 8 for the adjustment of buoyance as the diver dived deeper below the water level. For this reason, in the deep diving condition, the larger pneumatic pressure F′ worked toward the outside of the air chamber so that in the case of the conventional core structure, the fused portion of the urethane sheet layer 2 was peeled apart or was broken in some cases.

As the core according to this invention, the structure is provided as the core members in which a pair of leather cloth sheets 4 made of double layers, a urethane sheet layer 2′ of identical structure with the leather cloth sheet 3 and a Nylon cloth sheet layer 1′ is provided inside of the air chamber 8. In this case, a pair of core members 4 is sewn by a sewing machine and coupled with a yarn 7 at the middle portions 6, and both end portions 5 of the core members 4 are fused and coupled with the urethane sheet layer 2′ of the core member 4 and the urethane sheet layer 2 of the leather cloth sheet 3. As the filling amount of air in the air chamber 8 is on the increase, as FIG. 2 shows, the pneumatic pressure F′ works strongly toward the outside against the upper side and lower side leather cloth sheets 3 and a pair of core members 4 forming the periphery of the air chamber. However, the core structure of this invention is constituted in such a manner that a pair of core members 4 is sewn and coupled with a yarn 7, the coupled portions are not easily broken even if the strong pneumatic pressure F′ is applied to the coupled portions of a pair of core members 4. Also, in this case, the tensile forces A and B of opposite directions work on the fused surfaces of the leather cloth sheet 3 and the core member 4 to generate the operation of peeling apart the fused poritons but there is an advantageous point that the surface fusing of the leather cloth sheet 3 and the core member 4 are not easily subjected to the peeling apart by a shift in the lateral direction mentioned above. Accordingly, when the core structure according to this invention is used, even if the strong pneumatic pressure F′ is applied to the inside of the air chamber 8, the core member 4 seldom breaks.

The core structure according to this invention can be manufactured by sewing and coupling a pair of core members 4 made of double layers, a Nylon cloth sheet layer 1′ and a urethane sheet layer 2 with a yarn 7 at the center portions 6 by setting the respective Nylon sheet layers 1′ inside in the first place, disposing a pair of coupled core members at a desired portion of an air chamber where the core members are located, and applying a pressure with high frequency to the upper side leather cloth sheet 3 in the direction of the upper part, and fusing both end portions 5 of the core members 4 to the upper side and lower side leather cloth sheets 3.

By the way, the core structure according to this invention can be applied to the air filled product made of a single layer film sheet of rubber or synthetic resin and the like. In this case, the core members by this invention can be made of a single layer film sheet of indentical material or a leather cloth sheet prepared by pasting the single layer film sheet and cloth sheet layer together.

Also, a pair of core members can be coupled by providing rivet holes on the coupled portions and riveting instead of the coupling with yarn sewing.

INDUSTRIAL UTILIZATION

By the way, the core structure according to this invention is particularly suitable for holding down the inflation by particularly strong pneumatic pressure. For example, bouyance adjusting apparatus for rubber boat, scuba diving, and life preserver and the like.

I claim:

1. In a core structure for holding down an inflation of an air filled product wherein said air filled product is made of leathery type sheets, the improved core structure comprising upper and lower leathery type sheets (3), each leathery type sheet (3) being of a double layer construction and each being formed by joining together a cloth sheet (1) and a high frequency wave fusible plastic sheet (2), said plastic sheets (2) being positioned toward the inside portion of said air filled product, a plurality of pairs of leathery type sheets (4) being provided as core members for said air filled product, each of said pairs of leathery type sheets (4) being of a double layer construction substantially identical to the double layer construction of said upper and lower leathery type sheets (3), each of said plurality of pairs of leathery type sheets (4) being positioned between said upper and lower leathery type sheets (3) such that the high frequency wave fusible plastic sheets (2′) associated respectively therewith are positioned in opposed relationship with the high frequency wave fusible plastic sheets (2) associated with said upper and lower leathery type sheets (3), each leathery type sheet (4) having its opposite end portions (5) fused respectively with the corresponding upper and lower leathery type sheets (3), and each of said pairs of leathery type sheets (4) being bonded in a central region thereof by sewing with yarn.

2. The improved core structure of claim 1 wherein each of said plastic sheets comprises a polymeric plastic selected from the group consisting of a polyurethane and a polyvinyl polymer or copolymer.

3. The improved core structure of claim 1 wherein each of said cloth sheets includes nylon.

4. The improved core structure of claim 1 wherein the cloth sheet and the plastic sheet associated with each of said leathery type sheets are joined together by adhesive means.

5. In a method of manufacturing a core structure for holding down an inflation of an air filled product wherein said air filled product includes upper and lower leathery type sheets, the improved method comprising the steps of (a) forming said upper and lower leathery type sheets (3) by joining together a plastic sheet (2) which can be fused by high frequency waves and a cloth sheet (!), (b) forming a core member for insertion between said upper and lower leathery type sheets, said core member including a pair of leathery type sheets (4) each made of a double layer construction substantially identical to the double layer construction of said upper and lower leathery type sheets (3), (c) bonding together said pair of leathery type sheets (4) forming said core member by positioning the cloth sheets (1) associated respectively therewith towards each other and sewing together with yarn (7) the central region (6) associated respectively therewith, (d) disposing said core member between said upper and lower leathery type sheets (3), (e) applying pressure from the upper part of the upper leathery type sheet (3) of the air filled product, and (f) fusing and bonding together the respective end portions (5) of said core member to the upper and lower leathery type sheets (3) by applying high frequency wave voltage.

6. The improved method of claim 5 wherein each of said plastic sheets comprises a polymeric plastic selected from the group consisting of a polyurethane and a polyvinyl polymer or copolymer.

7. The improved method of claim 5 wherein each of said cloth sheets includes nylon.

8. An improved core structure for holding down an inflation of an air filled product comprising a first pair of spaced apart flexible sheet members forming the upper and lower members of said air filled product, each of said first pair of flexible sheet members including a cloth sheet and a high frequency wave fusible plastic sheet, at least one core member positioned between said first pair of flexible sheet members, said core member including a second pair of flexible sheet members each including a cloth sheet and a high frequency wave fusible plastic sheet, said core member being positioned between said first pair of flexible sheet members such that the high frequency wave fusible plastic sheet associated with one of said second pair of flexible sheet members is positioned adjacent to the high frequency wave fusible plastic sheet associated with one of said first pair of flexible sheet members and the high frequency wave fusible plastic sheet associated with the other of said second pair of flexible sheet members is positioned adjacent to the high frequency wave fusible plastic sheet associated with the other of said first pair of flexible sheet members, each of the flexible sheet members of said core member having portions adjacent the respective ends thereof which are fusible with the respective flexible sheet members associated with said first pair of flexible sheet members, said second pair of flexible sheet members being coupled together at an intermediate location along the respective lengths thereof.

9. The improved core structure of claim 8 wherein said second pair of flexible sheet members are coupled together by stitching.

10. The improved core structure of claim 8 wherein said second pair of flexible sheet members are coupled together by riveting.

11. The improved core structure of claim 8 including a plurality of core members positioned between said first pair of flexible sheet members.

12. A method for manufacturing a core structure for holding down an inflation of an air filled product, said air filled product including upper and lower flexible sheet members, said improved method comprising the steps of (a) forming the upper and lower flexible sheet members of said air filled product by joining together a high frequency wave fusible plastic sheet and a cloth sheet, (b) arranging said upper and lower flexible sheet members in spaced apart relationship such that the high frequency wave fusible plastic sheets associated respectively therewith are positioned towards each other, (c) forming a core member for positioning between the upper and lower flexible sheet members of said air filled product, said core member including a second pair of flexible sheet members, each of said second pair of flexible sheet members being of a construction substantially similar to the construction of the upper and lower flexible sheet members associated with said air filled product and each including a high frequency wave fusible plastic sheet and a cloth, (d) arranging said second pair of flexible sheet members such that the cloth sheets associated respectively therewith are positioned towards each other, (e) coupling together said second pair of flexible sheet members at an intermediate location therealong, (f) disposing said core member between the upper and lower flexible sheet members of said air filled product such that the high frequency wave fusible plastic sheet associated with one of the flexible sheet members of said core member is positioned adjacent to the high frequency wave fusible plastic sheet associated with one of said upper and lower flexible sheet members and the high frequency wave fusible plastic sheet associated with the other flexible sheet member of said core member is positioned adjacent to the high frequency wave fusible plastic sheet associated with the other of said upper and lower flexible sheet members, (g) applying pressure from the upper portion of said upper flexible sheet member, and (h) fusing together the respective end portions of said second pair of flexible sheet members to the upper and lower flexible sheet members by applying high frequency wave voltage.

* * * * *

UNITED STATES PATENT OFFICE
CERTIFICATE OF CORRECTION

Patent No. 4,823,417 Dated April 25, 1989

Inventor(s) Miwa Fukuichi

It is certified that error appears in the above-identified patent and that said Letters Patent is hereby corrected as shown below:

Column 1, line 17, ",inside" should be --inside--.

Column 5, line 12, "(!)" should be --(1)--.

Signed and Sealed this

Third Day of October, 1989

*Attest:*

DONALD J. QUIGG

*Attesting Officer*

*Commissioner of Patents and Trademarks*